US009749765B2

(12) United States Patent
Shiotani

(10) Patent No.: US 9,749,765 B2
(45) Date of Patent: Aug. 29, 2017

(54) WIRELESS RECEIVER

(71) Applicant: KABUSHIKI KAISHA AUDIO-TECHNICA, Machida-shi, Tokyo (JP)

(72) Inventor: Masaki Shiotani, Machida (JP)

(73) Assignee: KABUSHIKI KAISHA AUDIO-TECHNICA, Machida-Shi, Tokyo (JP)

( * ) Notice: Subject to any disclaimer, the term of this patent is extended or adjusted under 35 U.S.C. 154(b) by 0 days.

(21) Appl. No.: 15/295,461

(22) Filed: Oct. 17, 2016

(65) Prior Publication Data

US 2017/0111750 A1 Apr. 20, 2017

(30) Foreign Application Priority Data

Oct. 19, 2015 (JP) ..... 2015-205505

(51) Int. Cl.
*H04R 29/00* (2006.01)

(52) U.S. Cl.
CPC ..... *H04R 29/004* (2013.01); *H04R 29/008* (2013.01); *H04R 2420/07* (2013.01); *H04R 2430/01* (2013.01)

(58) Field of Classification Search
CPC ..... H04R 29/008; H04R 2430/01; H04R 2420/07; H04W 8/22
USPC ..... 381/58, 72, 120, 74, 56; 455/418, 556.1; 704/500
See application file for complete search history.

(56) References Cited

U.S. PATENT DOCUMENTS 5,613,232 A * 3/1997 Toshida ..... H04B 17/309 455/154.2
2005/0151662 A1* 7/2005 Kashuba ..... G01S 3/30 340/690

FOREIGN PATENT DOCUMENTS

JP H08-223097 A 8/1996

* cited by examiner

*Primary Examiner* — Melur Ramakrishnaiah
(74) *Attorney, Agent, or Firm* — Manabu Kanesaka

(57) ABSTRACT

In a wireless receiver having a plurality of antennas for wireless microphones, variation in received signal strength from the plurality of antennas is eliminated when displayed on an indicator.

The receiver includes a plurality of receiving circuits respectively corresponding to the plurality of antennas outputs a received signal strength as a detection voltage received by each of the antennas, an indicator that displays the received signal strength by the number of lighting segments, a lookup table in which a correspondence relation between a value of the detection voltage and the number of lighting segments of the indicator is set for each of the receiving circuits, and a display unit that refers to the lookup table based on the value of the detection voltage output from the plurality of receiving circuits and displays a level signal based on the number of lighting segments of the indicator set in the lookup table.

6 Claims, 4 Drawing Sheets

Fig. 3A

6

| ELECTRIC FIELD STRENGTH (ES) | NUMBER OF PIECES OF LIGHTING OF INDICATOR | AntA DETECTION VOLTAGE (DV_A) (V) | AntB DETECTION VOLTAGE (DV_B) (V) |
|---|---|---|---|
| E 1 | 1 | V1_a | V1_b |
| E 2 | 2 | V2_a | V2_b |
| E 3 | 3 | V3_a | V3_b |
| E 4 | 4 | V4_a | V4_b |
| E 5 | 5 | V5_a | V5_b |

Fig. 3B

6

| ELECTRIC FIELD STRENGTH (ES) | NUMBER OF PIECES OF LIGHTING OF INDICATOR | AntA DETECTION VOLTAGE (DV_A) (V) | AntB DETECTION VOLTAGE (DV_B) (V) |
|---|---|---|---|
| 0 | 0 | 0 | 0 |
| $0 < ES \leq E1$ | 1 | $0 < DV_A \leq V1_a$ | $0 < DV_B \leq V1_b$ |
| $E1 < ES \leq E2$ | 2 | $V1_a < DV_A \leq V2_a$ | $V1_b < DV_B \leq V2_b$ |
| $E2 < ES \leq E3$ | 3 | $V2_a < DV_A \leq V3_a$ | $V2_b < DV_B \leq V3_b$ |
| $E3 < ES \leq E4$ | 4 | $V3_a < DV_A \leq V4_a$ | $V3_b < DV_B \leq V4_b$ |
| $E4 < ES \leq E5$ | 5 | $V4_a < DV_A \leq V5_a$ | $V4_b < DV_B \leq V5_b$ |

Fig. 4

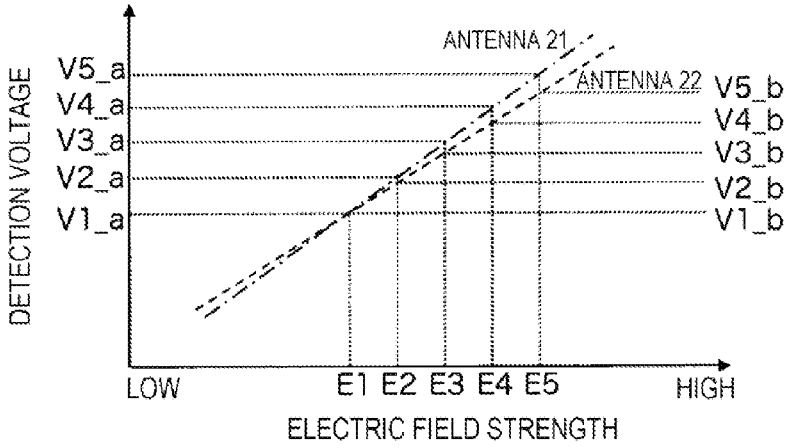

| ELECTRIC FIELD STRENGTH | NUMBER OF PIECES OF LIGHTING OF INDICATOR | DETECTION VOLTAGE (V) |
|---|---|---|
| E 1 | 1 | 0.25 |
| E 2 | 2 | 0.35 |
| E 3 | 3 | 0.45 |
| E 4 | 4 | 0.55 |
| E 5 | 5 | 0.65 |

WIRELESS RECEIVER

RELATED APPLICATIONS

The present application is based on, and claims priority from, Japanese Application No. JP2015-205505 filed Oct. 19, 2015, the disclosure of which is hereby incorporated by reference herein in its entirety.

BACKGROUND OF THE INVENTION

Field of the Invention

The present invention relates to a wireless receiver that receives a radio wave from, for example, a wireless microphone and demodulates an audio signal, in particular, to the wireless receiver which can appropriately display a radio wave reception state on an indicator.

Description of the Related Art

A wireless microphone and a wireless receiver are normally used in one-to-one relation. That is, in multi-wave operation in which a plurality of wireless microphones is simultaneously used on a stage or the like, the same number of wireless receivers tuned with transmission frequencies of the respective wireless microphones are used.

In this case, according to Japanese Radio Law, for example, as a frequency band that can be used for a type B wireless microphone, 30 channels are allocated for a specified low power radio device, in which a range of 806.125 to 809.750 MHz is equally divided in units of 0.125 MHz.

By the way, a reception state of the radio wave received in each wireless receiver can be known by displaying a reception strength (also referred to as a reception level) on an indicator or can be known from the number of pieces of lighting of the indicator. What is displayed on the indicator is preferably in proportion to the received radio wave strength ideally.

However, there has been a problem that, in a case where each wireless receiver has a plurality of antennas such as in a diversity system, there is a variation in a detection level (detection voltage) of a receiving circuit (detection element) of each of the antennas, and as a result a difference occurs in the display of the number of lighting segments on the indicator despite the same electric field strength.

For example, in a case where characteristics of receiving circuits of two antennas, Ant_A, Ant_B, are different from each other, as illustrated in a graph (a detection voltage relative to electric field strength) of FIG. 5, the detection voltages relative to the electric field strengths E1, E2, E3, E4, E5 have different values from each other as illustrated in FIG. 6 (on the graph of FIG. 6, ○ (a white circle) indicates a detection voltage of the antenna Ant_A, Δ (a white triangle) indicates a detection voltage of the antenna Ant_B).

Here, the number of lighting segments of the indicator (1 to 5) corresponding to the detection voltage (a numerical value in the table is an example) is set in advance as illustrated in a lookup table of FIG. 7. Accordingly, when the detection voltages are different from each other although the electric field strengths are the same between the antenna Ant_A and the antenna Ant_B, there is a possibility that a difference occurs in the number of lighting segments of the indicator as illustrated in FIG. 8.

To address the problem that received electric field strengths are different between the antennas, Japanese Unexamined Patent Application Publication No. 08-223097 A discloses a received electric field strength detection circuit that adjusts a variable resistor of a resistive potential divider circuit so that a received electric field detection signal RSSI (Received Signal Strength Indication) output from a receiving circuit 1 and a received electric field detection signal (RSSI) output from a receiving circuit 2 have the same voltage, when electric fields of the same level are inputted to a first antenna and a second antenna.

However, in a configuration of an invention described in the patent application No. 08-223097 A, a variation in detection characteristics is eliminated by adjusting the detection voltage to be same at a predetermined point (adjustment point) of the electric field strength, and there has been a problem that the variation of the received electric field strength becomes greater as the electric field strength is far from the adjustment point.

That is, there has been a problem that, when the electric field strength away from the adjustment point is received, the difference occurs in the number of lighting segments displayed on each indicator corresponding to each of the antennas.

SUMMARY OF THE INVENTION

Focusing on the above problems, it is an object of the present invention to provide a wireless receiver that receives a radio wave from a wireless microphone by a plurality of antennas and demodulates an audio signal, and allows to suppress a variation of display of an received signal strength when the received signal strength received by each of the antennas is displayed on an indicator.

To achieve the above object, a wireless receiver according to the present invention which receives a radio wave from a wireless microphone by a plurality of antennas and demodulates an audio signal, includes: a plurality of receiving circuits each of which respectively corresponds to the plurality of antennas, and outputs a received signal strength received by each of the antennas as a detection voltage; an indicator that displays the received signal strength received by the plurality of antennas with the number of lighting segments; a lookup table in which a correspondence relationship between a value of the detection voltage and the number of lighting segments of the indicator is set for each of the receiving circuits; and a display unit that refers to the lookup table based on the value of the detection voltage outputted from the plurality of receiving circuits and displays on the indicator the number of lighting segments of the indicator set in the lookup table, as a level signal.

It is preferable that a plurality of the indicators is respectively provided in correspondence to the plurality of antennas, and the display unit refers to the lookup table for each of the receiving circuits and displays on the indicator the number of lighting segments of the indicator set in the lookup table, as the level signal.

The wireless receiver preferably includes a muting unit that performs mute control with the level signal as a reference signal.

Alternatively, the wireless receiver may include an attenuation unit that performs attenuation processing of a signal with the level signal as a reference signal.

The lookup table is formed for each reception circuit in such a manner that the detection voltages of received signals with antennas for a plurality of different electric field strength correspond to the number of lighting segments for the detection voltages, and the number of lighting segments on the indicator for the same detection voltage is identical in a plurality of reception circuits.

The values of detection voltage to be set in the lookup table are determined by approximate calculation performed such that each of in-advance measured reception characteristics of antenna and reception circuit is consistent with each other.

With such a configuration, a relationship between the detection voltage and the number of lighting segments of the indicator is set for each of the receiving circuits in the lookup table to absorb difference in reception characteristics between the receiving circuits. Thus, in a case where the received electric field strengths are the same, a variation of the number of lighting segments of the indicator can be prevented even when there is a difference between the reception characteristics.

BRIEF DESCRIPTION OF THE DRAWING

FIG. 3A is an example of a lookup table included in the wireless receiver of FIG. 1;

FIG. 3B is another example of a lookup table in the wireless receiver of FIG. 1;

FIG. 4 is a graph illustrating reception characteristics of antennas (receiving circuits) included in the wireless receiver of FIG. 1;

DESCRIPTION OF THE PREFERRED EMBODIMENTS

Hereinafter, an embodiment of the present invention will be described with reference to the drawings. An example illustrated below is a wireless receiver that receives a frequency modulated radio frequency (FMRF) signal from a wireless microphone as a transmitter and demodulates an audio signal, and FIG. 1 is a block diagram illustrating an entire configuration including an indicator display unit of the wireless receiver, and FIG. 2 is a block diagram of a receiving circuit included in FIG. 1.

Figure 1:
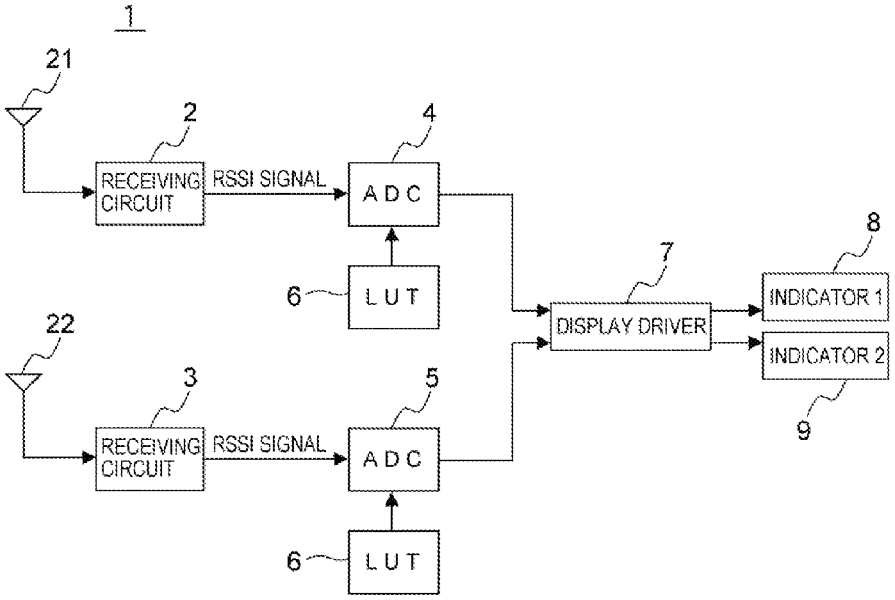
FIG. 1 is a block diagram illustrating an entire configuration including an indicator display unit of a wireless receiver.

A configuration of the wireless receiver 1 illustrated in FIG. 1 illustrates a receiver of diversity system, which includes, for example, two antennas 21, 22. RF signals received by the antennas 21, 22 are respectively supplied to receiving circuits 2, 3 that are detection elements of the respective antennas.

Figure 2:
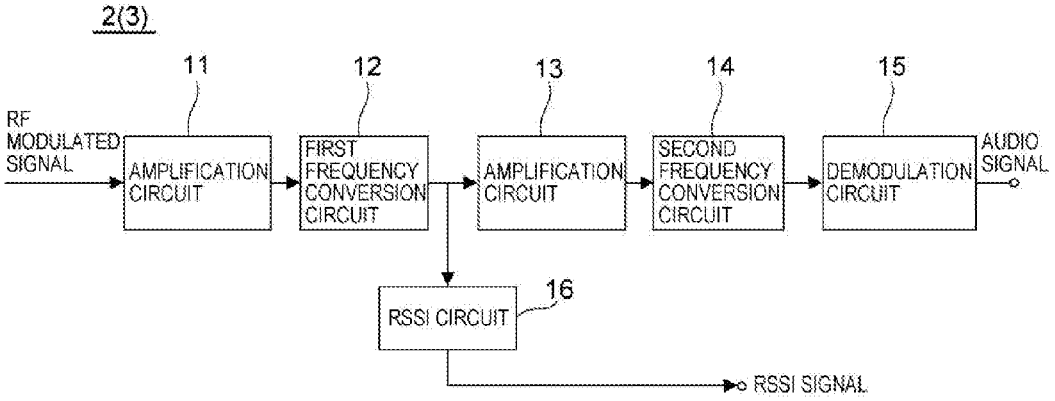
FIG. 2 is a block diagram of a receiving circuit included in the wireless receiver of FIG. 1.
Figure 5:
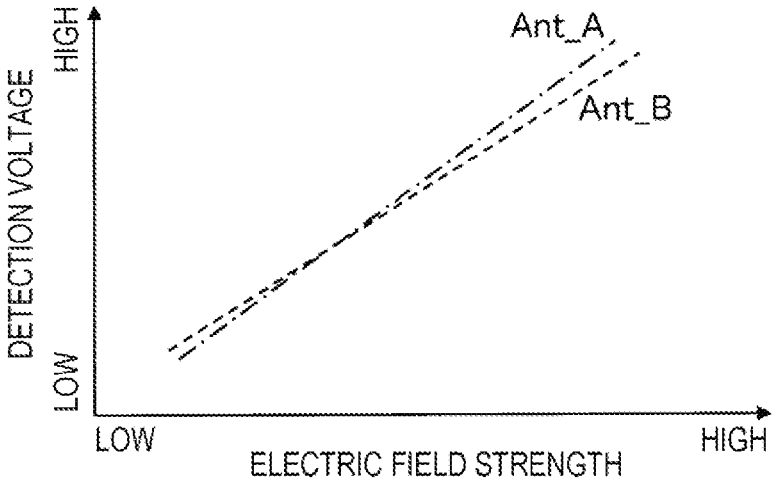
Fig. 5 Prior Art
FIG. 5 is a graph illustrating reception characteristics of antennas of a diversity system.

In the receiving circuits 2, 3, as illustrated in FIG. 2, the RF signal received by each of the antennas 21, 22 is supplied to an RF amplification circuit 11.

The RF amplification circuit 11 includes an attenuator (not illustrated) as an RF signal attenuation circuit at an input, and is configured so that an amount of attenuation of the RF signal applied to the RF amplification circuit 11 from each of the receiving antennas 21, 22 can be selected by the attenuator (ATT).

Incidentally, instead of the attenuator (ATT), the RF amplification circuit 11 can adjust the amount of attenuation by controlling an amount of feedback of a gain adjustment circuit, for example an automatic gain control (AGC), that adjusts amplification gain of the RF amplification circuit 11.

The RF signal from the RF amplification circuit 11 is supplied to a first frequency conversion circuit 12. The first frequency conversion circuit 12 is supplied with a signal from a first local signal oscillator (not illustrated) of, for example, a PLL synthesizer, and a first intermediate frequency signal (first IF signal) is generated from the RF signal and a first local signal. That is, by selection of the first local signal of the PLL synthesizer, the intermediate frequency signal corresponding to a particular reception frequency is generated, and is supplied to an intermediate frequency amplification circuit 13. The first IF signal amplified by the intermediate frequency amplification circuit 13 is supplied to a second frequency conversion circuit 14.

The second frequency conversion circuit 14 is supplied with a fixed local signal from a second local signal oscillator (not illustrated), and a second intermediate frequency signal (second IF signal) is generated from the first intermediate frequency signal (first IF signal) and a second local signal. That is, the wireless receiver adopts a double superheterodyne system.

The second intermediate frequency signal (second IF signal) is demodulated to the audio signal by a demodulation circuit 15 including a limiter amplifier, and is outputted to an audio processing circuit (not illustrated).

Meanwhile, the first intermediate frequency signal (first IF signal) is subjected to level detection in an RSSI circuit 16 to output a received electric field strength, and the received electric field strength is outputted to each of AD converters 4, 5 to be converted into a digital value.

Here, regarding values of the detection voltage (outputs of AD converters 4, 5) detected by the receiving circuits 2, 3, a lookup table (LUT) 6 illustrated in FIG. 3A is referred to by a microcomputer (not illustrated), and information of the number of lighting segments of the indicator corresponding to the (belonging range of) detection voltage value is supplied to a display driver 7 (the microcomputer and the display driver 7 constitute a display unit).

In the lookup table 6 illustrated in FIG. 3A, a correspondence between the detection voltage and the number of lighting segments of the indicator is set for each of the receiving circuits 2, 3 so that difference of the reception characteristics between the receiving circuits 2, 3 can be absorbed. That is, as illustrated in a graph of FIG. 4, in a case of, for example, electric field strengths E2, E3, E4, and E5, detection voltages V2_a to V5_a in the receiving circuit 2 of the antenna 21 have different values from detection voltages V2_b to V5_b in the receiving circuit 3 of the antenna 22. Therefore, the number of lighting segments of the indicator corresponding to the detection voltage is set for each of the receiving circuits.

By using the lookup table 6 thus configured, in a case where electric field strengths received in the antennas 21, 22 are the same, the indicators corresponding to the respective antennas can display the same number of lighting segments of the indicator.

The display driver 7 controls to turn on the segments of the indicator 8, 9 corresponding to the number of lighting segments (level signal) which is received from each of the receiving circuits 2, 3.

Figure 6:
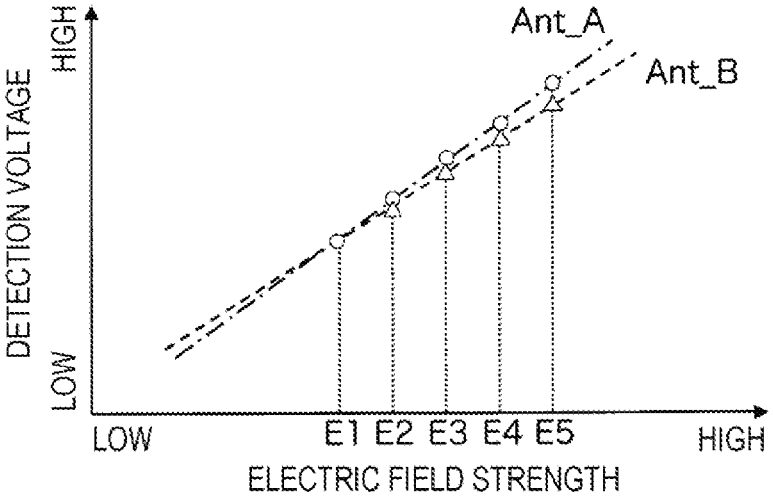
Fig. 6 Prior Art
FIG. 6 is a diagram for describing a difference between reception characteristics of two antennas in the graph of FIG. 5.
Figures 7, 8:
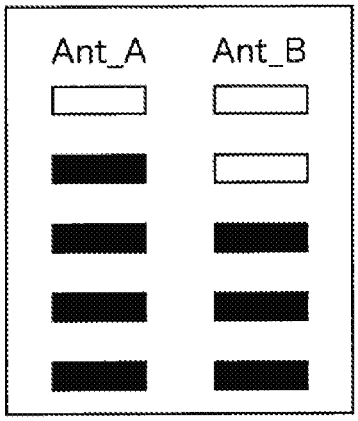
Fig. 7 Prior Art
Fig. 8 Prior Art
FIG. 7 is a conventional lookup table in which a correspondence relationship is set between a detection voltage and the number of lighting segments of an indicator.
FIG. 8 is a diagram illustrating an example of an indicator that displays a reception strength for each of the antennas.

In addition, since widths of detection voltage for signals received with antenna 21 and antenna 22 is finer, the lookup table in FIG. 3B may be used instead of the lookup table in FIG. 6A.

The value of the detection voltage for each of the receiving circuits 2, 3 to be set in the lookup table 6 is determined based on approximation calculation so that characteristic curves, obtained by measuring reception characteristics (curve characteristics) in advance at each antenna 21, 22 (receiving circuits 2,3), coincide to each other.

As described above, with the embodiment according to the wireless receiver of the present invention, the relationship between the detection voltage and the number of lighting segments of the indicator is set for each of the receiving circuits 2,3 in the lookup table 6 to absorb difference in reception characteristics between the receiving circuits 2, 3.

Thus, in a case where the received electric field strengths are the same, the numbers of lighting segments of the indicator can be the same even when there is a difference between the reception characteristics.

Incidentally, in the embodiment, the wireless receiver has a configuration that includes the indicators 8, 9 respectively corresponding to the antennas 21, 22 (receiving circuits 2, 3); however, the present invention is not limited to the configuration.

For example, the present invention can also be applied to a configuration that displays the level signal in one indicator by switching a plurality of antennas.

In the embodiment, a configuration example has been described in which two antennas are included; however, the present invention is not limited to the configuration. The present invention can be applied to a configuration in which, for example, four antennas and their receiving circuits are included.

In the embodiment, each of the corrected outputs of the AD converters 4, 5 has been used for only the indicator; however, the present invention is not limited thereto. Since detection variation in the electric field strength can be eliminated, control without variation can be performed by using the voltage value (level signal) as a reference signal. For example, control of the attenuator (ATT) as a means of signal attenuation can be performed for each of the antennas (for each of the signal systems), or mute control can be performed for each of the antennas (for each of the signal systems), and reduction of their variation can be easily achieved.

What is claimed is:

1. A wireless receiver that receives a radio wave from a wireless microphone by a plurality of antennas and demodulates an audio signal, the wireless receiver comprising:

a plurality of receiving circuits that respectively corresponds to the plurality of antennas and each of which outputs a received signal strength of a received signal by each of the antennas, as a detection voltage;

an indicator that displays the received signal strength received by the plurality of antennas by the number of lighting segments;

a lookup table in which a correspondence relationship between a value of the detection voltage and the number of lighting segments of the indicator is set for each of the receiving circuits; and a display unit that refers to the lookup table based on the value of the detection voltage outputted from the plurality of receiving circuits and displays on the indicator the number of lighting segments of the indicator set in the lookup table, as a level signal.

2. The wireless receiver according to claim 1, wherein the plurality of indicators is respectively provided in correspondence to the plurality of antennas, and the display unit refers to the lookup table for each of the receiving circuits and displays on the indicator the number of lighting segments of the indicator set in the lookup table, as the level signal.

3. The wireless receiver according to claim 1, further comprising a muting unit that performs mute control with the level signal as a reference signal.

4. The wireless receiver according to claim 1, further comprising an attenuation unit that performs attenuation processing of a signal with the level signal as a reference signal.

5. The wireless receiver according to claim 2, wherein the lookup table is formed for each reception circuit in such a manner that the detection voltages of received signals with antennas for a plurality of different electric field strength correspond to the number of lighting segments for the detection voltages, and the number of lighting segments of the indicator for the same detection voltage is identical in a plurality of reception circuits.

6. The wireless receiver according to claim 1, wherein values of detection voltage to be set in the lookup table are determined by approximate calculation performed such that each of in-advance measured reception characteristics of antenna and reception circuit is consistent with each other.

* * * * *